United States Patent [19]

Bako et al.

[11] Patent Number: 4,499,681

[45] Date of Patent: Feb. 19, 1985

[54] SECURITY DEVICE FOR FIREARMS

[75] Inventors: Lazlo Bako, Woodcliff Lake; Stephen S. Scelba, Clifton, both of N.J.

[73] Assignee: Presto Lock, Inc., Garfield, N.J.

[21] Appl. No.: 472,766

[22] Filed: Mar. 7, 1983

[51] Int. Cl.[3] ..... F41C 27/10

[52] U.S. Cl. ..... 42/1 Y; 42/1 LP

[58] Field of Search ..... 42/1 Y, 1 LP, 70 E, 42/70 R

[56] References Cited

U.S. PATENT DOCUMENTS

| | | | |
|---|---|---|---|
| 1,686,482 | 10/1928 | Windle | 42/1 Y |
| 2,512,140 | 11/1950 | Childs et al. | 42/70 |
| 2,664,658 | 7/1954 | Bjorklund | 42/70 |
| 2,893,152 | 7/1959 | Puluso | 42/1 Y |
| 3,031,787 | 6/1962 | Womble, Jr. | 42/70 |
| 3,066,433 | 5/1962 | Rogers et al. | 42/70 |
| 3,139,694 | 10/1964 | Schaefer | 42/70 |
| 3,164,919 | 1/1965 | Hall | 42/70 |
| 3,368,297 | 3/1968 | Lentz | 42/1 |
| 3,392,471 | 5/1968 | Foote | 42/70 |
| 3,422,560 | 2/1969 | Foote et al. | 42/70 |
| 3,624,945 | 10/1971 | Foote | 42/1 |
| 4,084,341 | 11/1978 | Cervantes | 42/1 |
| 4,198,026 | 7/1980 | Capolupo | 248/552 |
| 4,299,045 | 8/1981 | Cervantes | 42/1 |

FOREIGN PATENT DOCUMENTS

| | | | |
|---|---|---|---|
| 968669 | 4/1964 | United Kingdom | 42/1 X |

*Primary Examiner*—Charles T. Jordan

*Attorney, Agent, or Firm*—Shapiro and Shapiro

[57] ABSTRACT

A security device for a firearm comprises a pair of covers adapted to be disposed on opposite sides of a firearm trigger guard. One of the covers has an elongate protruding housing containing the latching portion of a latch member and the other cover is formed with an opening in which is disposed a catch member adapted to engage and retain the latching portion when the covers are pressed together with the trigger guard therebetween and with the housing being projected through the trigger guard into the opening. The covers when mutually engaged embrace the trigger guard and prevent operation of the trigger. The latch member may be moved out of engagement with the catch member to release the covers by means of a manual actuator which is controlled by a combination lock contained in the cover which is provided with the latch member. The device may be applied to a range of different firearms.

19 Claims, 10 Drawing Figures

FIG. 1.
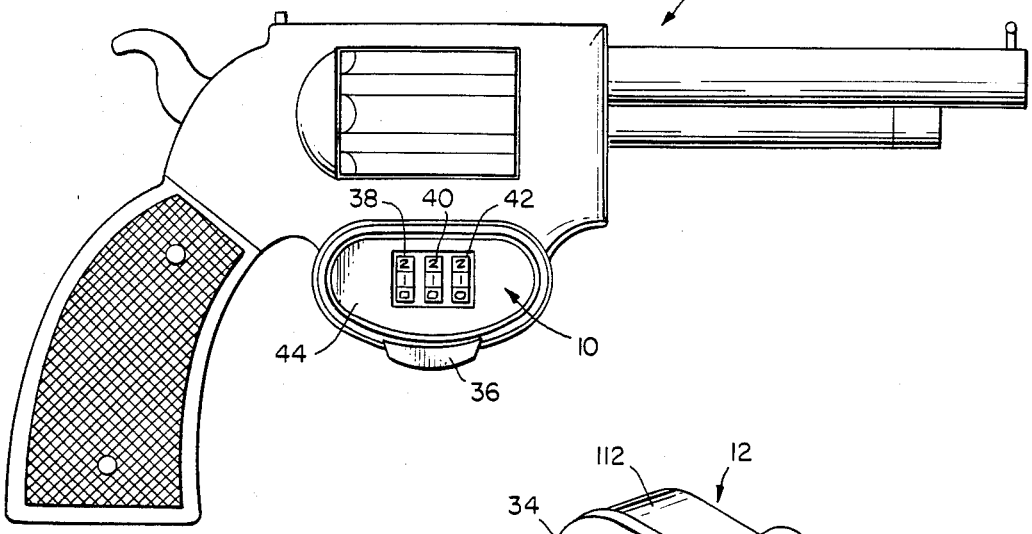
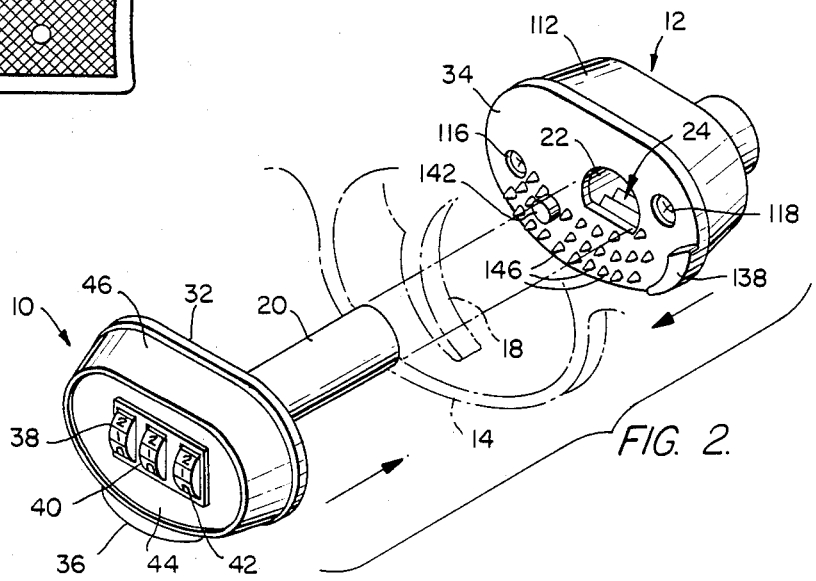
FIG. 2.
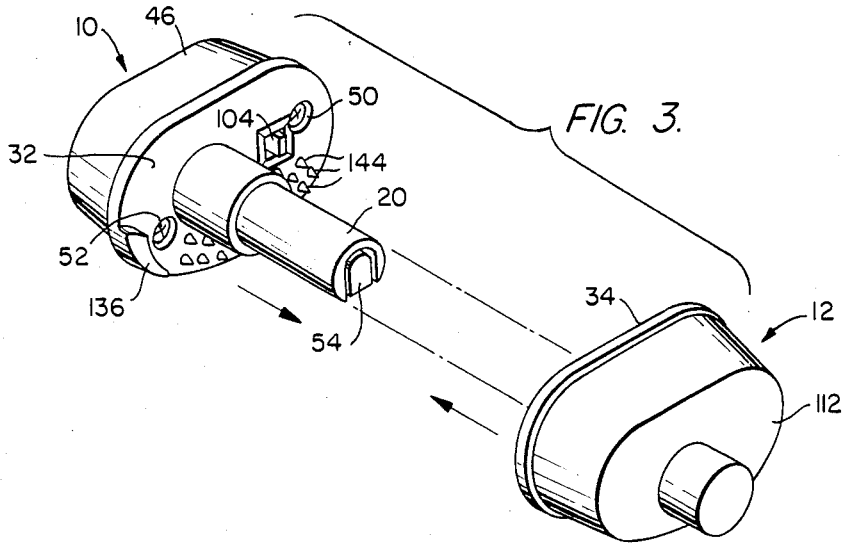
FIG. 3.

SECURITY DEVICE FOR FIREARMS

BACKGROUND OF THE INVENTION

Firearms such as handguns, rifles and the like are commonly manufactured with some form of safety, but such a safety is not, in itself, generally sufficient in preventing or deterring unauthorized use of a firearm. It may, accordingly, be expedient to have an additional security device, which can be applied to a firearm to prevent its unauthorized use (and possibly serve as a deterrent against theft of the firearm) but which can be readily removed by an authorized user. The present invention provides such a device.

SUMMARY OF THE INVENTION

The invention provides a security device for preventing unauthorized use of a firearm, which device is in the form of a self-contained trigger guard cover assembly that is of small size, and that may be readily applied to a wide range of firearms. The device is simple to apply and remove by an authorized user, but affords good protection against removal by unauthorized personnel.

Broadly stated, in one of its aspects, the invention provides a security device for preventing unauthorized use of a firearm, the device comprising a pair of covers adapted to be disposed on opposite sides of a firearm trigger guard, respectively. A latch member is associated with one of the covers and has an elongate latching portion protruding from that cover. The other cover is formed with an opening in which is disposed a catch member adapted to engage and retain the latching portion when the covers are pressed together with the trigger guard therebetween and with the latching portion projected longitudinally through the trigger guard into the opening. The covers, when mutually engaged, are adapted to embrace the trigger guard and prevent operation of the trigger. The latch member is movable transversely of the length of the latching portion between latching and unlatching positions with respect to the catch member. A manual actuator is provided for moving the latch member from the latching position to the unlatching position, and a lock with exposed operating means is provided for preventing movement of the latch member from the latching position to the unlatching position except when the operating means is set to open the lock.

In one preferred aspect of the invention, the lock includes a locking member movable between locked and unlocked positions in relation to the latch member, the locking member when in the locked position blocking movement of the latch member from the latching to the unlatching position and when in the unlocked position allowing actuator-initiated movement of the latch member to the unlatching position. The operating means of the lock comprises rotary combination dials for controlling the position of the locking member whereby the locking member assumes the unlocked position only when the dials are set on a predetermined combination. The latching portion of the latch member and the catch member are formed with complementary ratchet teeth for providing latching engagement therebetween, the arrangement of the latch and catch members being such as to permit such engagement even when actuator-initiated movement of the latch member is blocked by the locking member.

In a further preferred aspect of the invention, the latching portion of the latch member is disposed in an elongate housing protruding from the cover that is provided with the latch member, the latching portion being exposed at one side of the housing. The housing enters the opening in the other cover when the covers are pressed together.

Additional features and advantages of the invention will be apparent from the ensuing description and claims taken in conjunction with the accompanying drawings.

BRIEF DESCRIPTION OF THE DRAWINGS

FIG. 1 is a side view of a handgun secured against unauthorized use by a security device in accordance with the invention;

FIG. 2 is an exploded perspective view of a pair of covers of the security device and illustrating the manner in which the device may be applied to the trigger guard of a firearm;

FIG. 3 is another exploded perspective view of the covers looking from the right-hand side of FIG. 2;

DESCRIPTION OF PREFERRED EMBODIMENT

Figure 8:
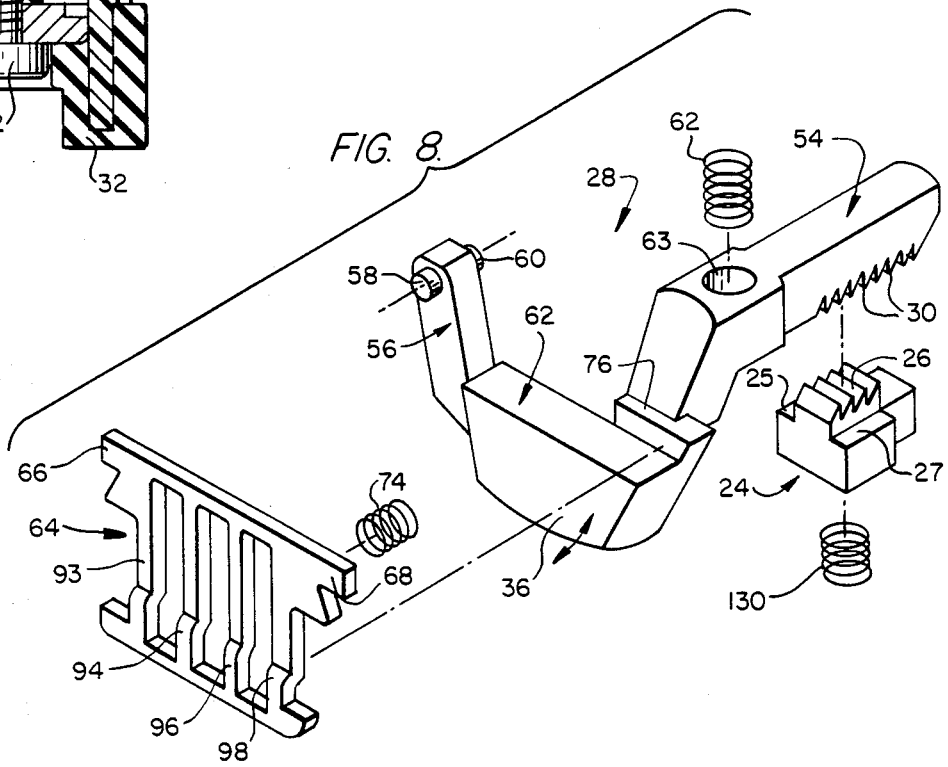
FIG. 8 is an exploded perspective view of cooperative parts of the security device comprising a latch member, a catch member, and a pivotal locking bolt.

Referring initially to FIGS. 1–3, there is illustrated a security device for a firearm, the device comprising a pair of covers 10 and 12, adapted to embrace the trigger guard 14 of a firearm, such as a handgun 16, to prevent unauthorized access to the trigger 18. With the covers separated, they may be brought together from opposite sides of the trigger guard (FIG. 2) and pressed together, with an elongate housing 20 which protrudes from cover 10 being projected through the trigger guard forwardly of the trigger and entering a corresponding opening 22 in cover 12. A catch member 24 having ratchet teeth 26 (see FIG. 8) is housed in cover 12 and cooperates with a latching portion 54 of a movable latch member 28 associated with cover 10, as will be described, the latching portion being accommodated in housing 20. Latching portion 54 has ratchet teeth 30 (see also FIG. 8) complementary to ratchet teeth 26 so that as the covers are pressed together a ratchet-type latching action is effected between the latch and catch members that prevents separation of the covers until the ratchet teeth are released. The covers may be pressed together sufficiently to provide tight engagement of their inner faces (constituted by cushions 32, 34, as will be described) against opposite surfaces of the trigger guard, thereby preventing access to the trigger until the covers are released.

In order to release the covers, it is necessary to move latch member 28 of cover 10 so as to disengage its ratchet teeth from the teeth of catch member 24, whereby the covers may be separated. A manual actuator comprising a push button 36 forming part of the latch member is provided for the purpose of moving the latch member out of engagement with the catch member, the push button protruding from cover 10 for manual operation thereof. Movement of latch member 28, however, is controlled by a combination lock incorporated in cover 10. The combination lock has operating means comprising rotary dials 38, 40, 42, each formed with a series of peripheral combination indicia, the dials being partially exposed through dial openings in a top plate 44 of cover 10. In order to move the latch member out of engagement with the catch member, it is necessary to set the lock's opening combination on the dials. In all other settings of the dials, the combination lock blocks the latch member against movement out of engagement with the catch member. Thus, in order to release the security device from a trigger guard, it is necessary for a user to know the opening combination of the lock. It is not, however, necessary for the latch member to be moved by push button 36 when engaging the catching member, because the latter is resiliently mounted in cover 12, as will be described. Thus, engagement between the latch member and catch member allowing the security device to be applied to a firearm can be effected even when movement of the latch member is blocked by the combination lock, i.e., even when the dials are "scrambled" and the lock is not set on its opening combination.

The number of ratchet teeth on the latching portion of latch member 28 may be sufficient to provide a range of engagement with the catch member, making the device suitable for use on trigger guards of different thickness. Also, the device may have outside dimensions and be of a configuration so as to be capable of covering trigger guards of diverse firearms.

The device will now be described in more detail with particular reference to FIGS. 4–10.

Figure 4:
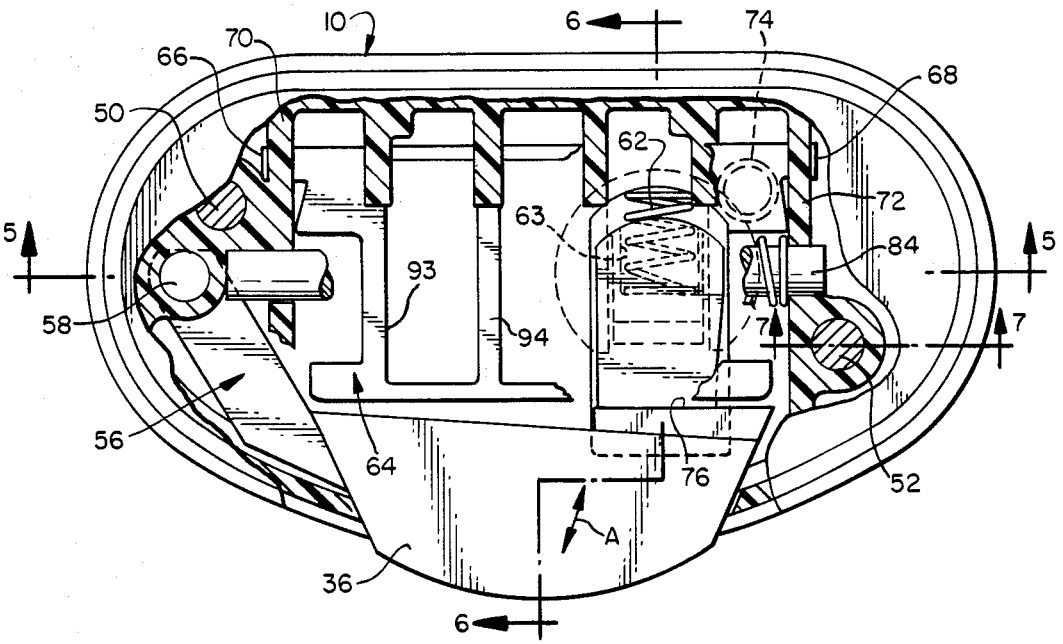
FIG. 4 is a broken-away elevational view of the security device with the covers in mutual engagement.
Figure 5:
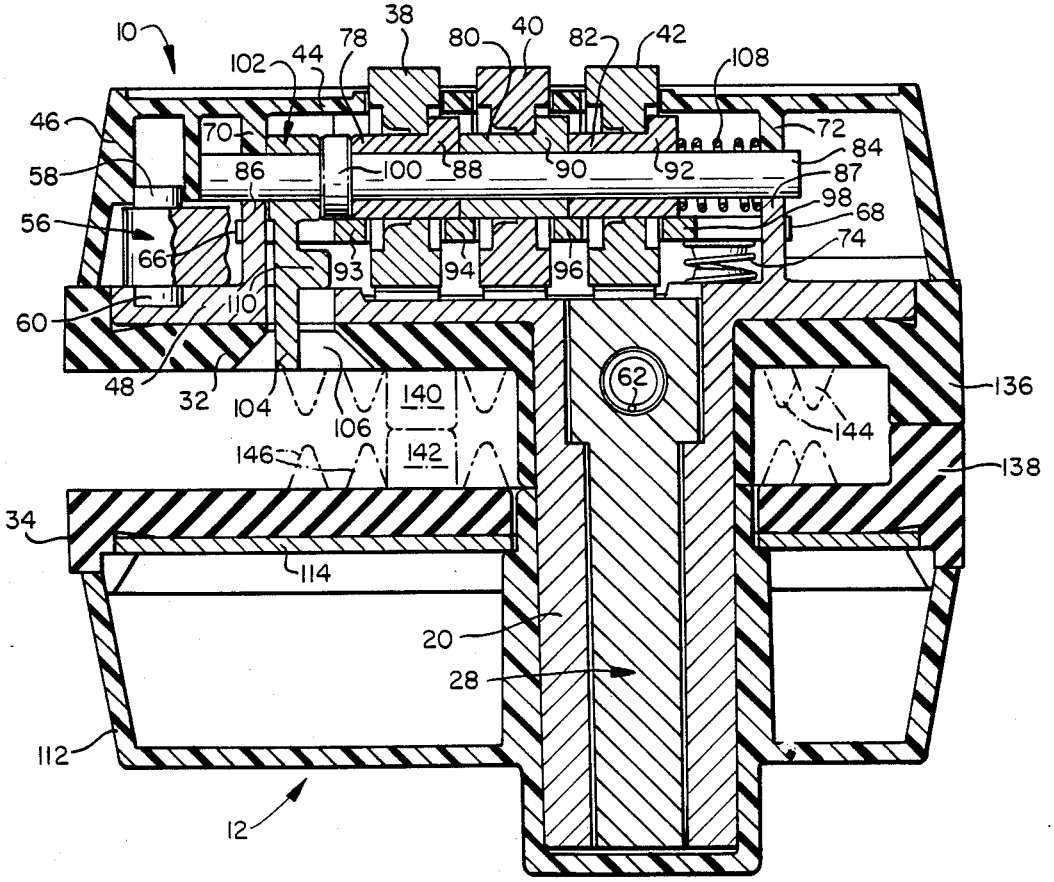
FIG. 5 is a sectional view on line 5—5 of FIG. 4.
Figure 6:
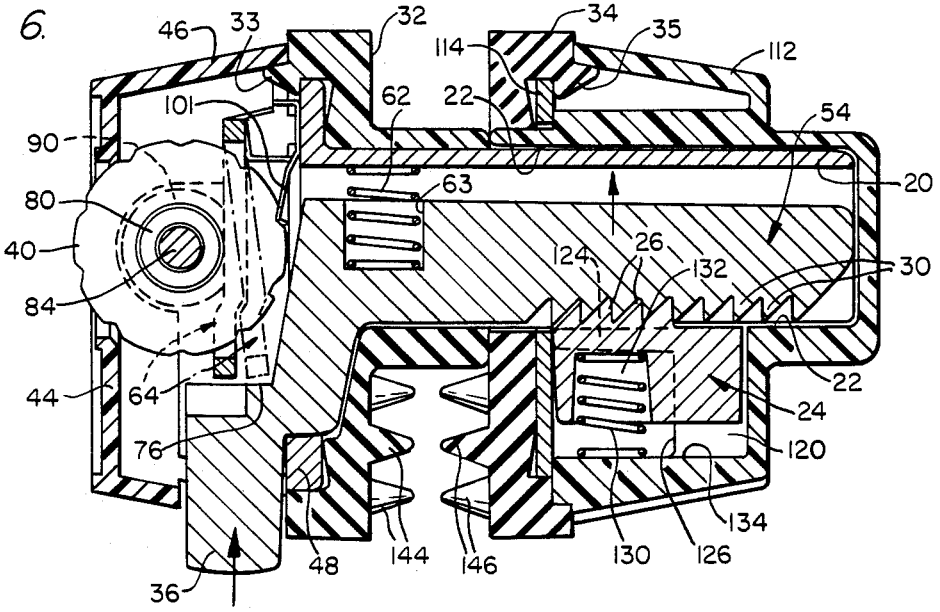
FIG. 6 is a sectional view on line 6—6 of FIG. 4.
Figure 7:
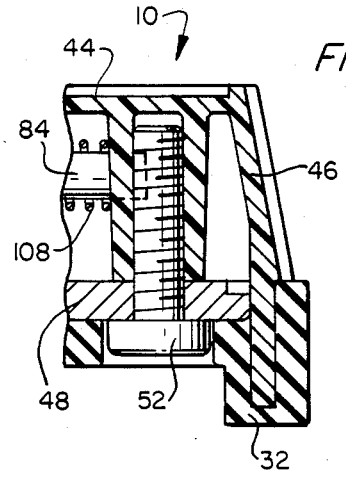
FIG. 7 is a sectional view on line 7—7 of FIG. 4.

As seen most clearly in FIGS. 5–7, cover 10 comprises an outer casing part 46, which may be a plastic molding, an inner casing part 48, which may be of diecast metal, and which includes the housing 20, and the cushion 32, which may be of a resilient plastic, rubber, or like material. The casing parts may be secured together by screws 50, 52 inserted through the inner casing part (see FIGS. 3, 4 and 7). Cushion 32 may have an internal bead portion 33, as shown in FIG. 6, trapped between the casing parts 46 and 48 to secure the cushion in place.

Latch member 28 (see also FIG. 8) may be a diecasting comprising the elongate latching portion 54, a pivot arm portion 56, formed with bosses 58, 60, and a bridging portion 62 connecting portions 54 and 56, the bridging portion also defining the push button 36. The latching portion 54 of the latch member fits in the protruding housing 20 with sufficient clearance to permit pivotal movement of the latch member, as described hereinafter. As seen in FIGS. 3, 4 and 6, housing 20 is open down one side so as to expose the ratchet teeth 30. The bosses 58, 60 of the latch member locate in suitable receiving pockets formed in casing parts 46 and 48 (see FIGS. 4 and 5) in a manner providing for pivotal movement of the latch member as a whole, as indicated by arrow A in FIG. 4. It will be seen more particularly from FIG. 8 that bosses 58 and 60 provide for pivoting of the latch member about an axis which is substantially parallel to the length of housing 20 and latching portion 54, so that the latching portion is supported for translational movement transversely of its length. A coil spring 62 fits in a blind bore 63 in the latching portion of the latch member, the coil spring pressing against the interior of housing 20 and biasing the latch member toward a latching position wherein its ratchet teeth are exposed for engagement with the corresponding ratchet teeth 26 of catch member 24. Pivotal movement of the latch member against the bias of spring 62, by the application of pressure on push button 36, moves the ratchet teeth out of engaging position, as indicated by the arrows in FIG. 6, i.e., such pressure moves the latching portion away from the open side of housing 20, from the latching position to an unlatching position of the latch member.

As previously alluded to, disengaging movement of the latch member can only be effected when the dials of the combination lock are set on the correct opening combination. This is because the lock includes a locking member comprising a pivotal bolt or fence 64 which, as will now be described, blocks movement of the latch member from its latching position, except when the lock is set on the correct opening combination.

Bolt 64 is pivotally mounted in casing part 46 by means of projecting lugs 66, 68 of the bolt which fit in suitable openings (not shown) in walls 70, 72 of the casing part (see FIG. 4). A coil spring 74 acting between locating projections on the bolt and casing part 8 (FIG. 5) urges the bolt toward a first (unlocked) position shown in FIG. 5 and in full line in FIG. 6. The bolt can be pivoted between the first position and a second (locked) position under the control of the combination dials 38, 40, 42 in a manner known per se in combination locks and which is described below. It will be seen from FIG. 6 that in the locked (dotted line) position of the bolt it is located in blocking relation to a blocking shoulder 76 formed on latch member 28, thereby preventing the latch member from being moved out of latching position with respect to the catch member. When, however, the bolt is in the unlocked (full line) position in FIG. 6 (which occurs when the combination lock is set on its correct opening combination) it clears the blocking shoulder 76, allowing latch member 28 to be moved out of latching position by depression of the push button 36.

Movement of the bolt between its locked and unlocked positions is effected by rotation of the combination dials. To this end, each of the dials is releasably and rotatably coupled to a corresponding rotary sleeve 78, 80, 82 in known manner (see particularly FIG. 5). The dials and sleeves may have interengaging teeth or the like (not shown) for this purpose. The dials and sleeves are rotatably mounted on a shaft 84 supported between walls 70, 72 of casing part 46 and complementary walls 86, 87 of casing part 48. The sleeves may have flanges 88, 90, 92 at one end of each, with the peripheries of the respective flanges defining cams which are circular except for a flat portion. The flanges are positioned peripherally to engage crossbars 94, 96, 98 of the bolt, and spring 74 acts to urge the crossbars into engagement with the flange peripheries. Thus, when the sleeves are rotated to positions in which the flats on the flanges are all in engagement with the bolt crossbars, as shown in FIG. 5, and in full line in FIG. 6 (i.e., the lock is set to its correct opening combination) the bolt assumes its unlocked position. When, however, any one (or more) of the sleeves is rotated from this position by its corresponding dial, its flange provides a camming action against the respective crossbar of the bolt, moving the bolt to its locked position shown in dotted line in FIG. 6. Then, to restore the bolt to its unlocked position, the dials must be restored to their predetermined positions establishing the lock's opening combination.

The combination lock also has a mechanism whereby the opening combination may be changed to one of a user's own particular choice, by uncoupling the dials from the sleeves, thereby allowing the rotational alignment of one or more of the dials relative to the respective sleeve(s) to be changed. It will be seen in FIG. 5 that shaft 84 has a collar 100 near one end, adjacent sleeve 78, and that a shift lever 102 is carried on the shaft between the collar and the walls 70, 86. The shift lever has a manual actuating portion 104 which is located in an opening 106 in cushion 32. Also, at the other end of shaft 84, a coil spring 108 presses against sleeve 82, thereby urging all of the sleeves into coupling engagement with their respective dials and, through collar 100, urging the shift lever to the left. When the dials are set on the opening combination of the lock, shift lever 102 can be moved to the right in opening 106, against the bias of spring 108, thereby uncoupling the sleeves from the dials and allowing one or more of the dials to be rotated independently of its respective sleeve, thereby changing the opening combination of the lock. The new combination is set when the shift lever is released and spring 108 presses the sleeves back into coupling engagement with the dials. The shift lever can only be operated when the lock is set on its opening combination, because in the locked position of the bolt, a blocking portion 110 of the shift lever is in alignment with crossbar 93 of the bolt, preventing movement of the shift lever. A dial spring 101 (FIG. 6) is provided, the spring having arms engaging the respective dial peripheries and entering notches therein to provide indexing movement of the dials between their respective indicia settings.

The construction and operation of the combination lock mechanism described above is known per se and will be readily apparent to those skilled in the art.

Cover 12, as seen particularly in FIGS. 5, 6, 9 and 10, includes a casing part 112, a casing part 114, which may be attached to casing 112 by screws 116, 118, inserted through part 114, and the afore-mentioned cushion 34. Cushion 34 may have an internal bead portion 35 (see FIG. 6) trapped between casing part 112 and casing part 114 to hold the cushion in place. Casing part 112 may be a plastic molding and part 114 may be metal.

Figure 9:
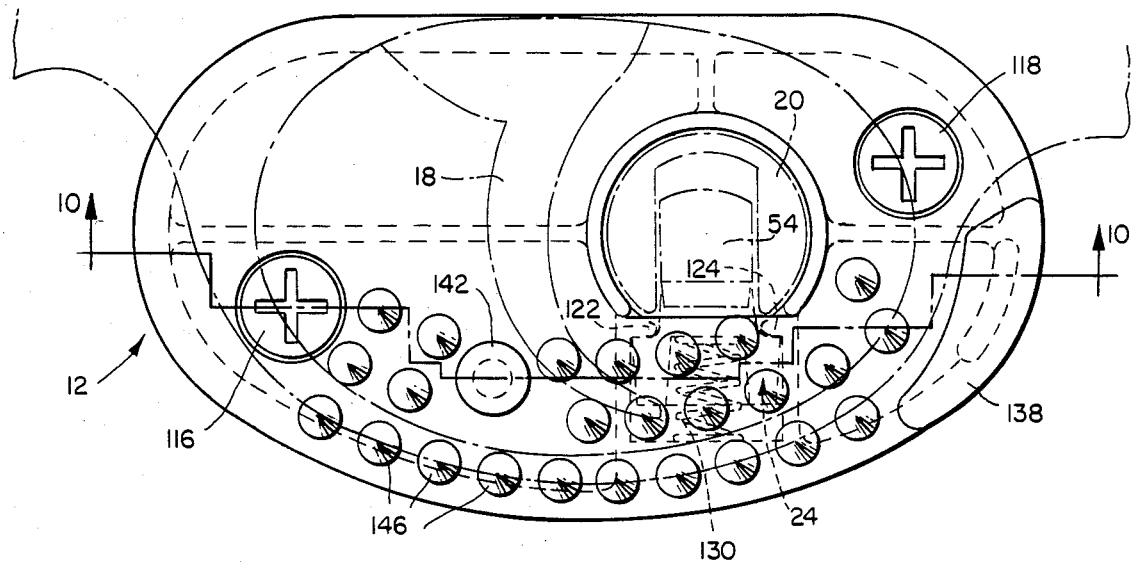
FIG. 9 is an elevational view of one of the covers showing the manner in which it fits against a typical firearm trigger guard.
Figure 10:
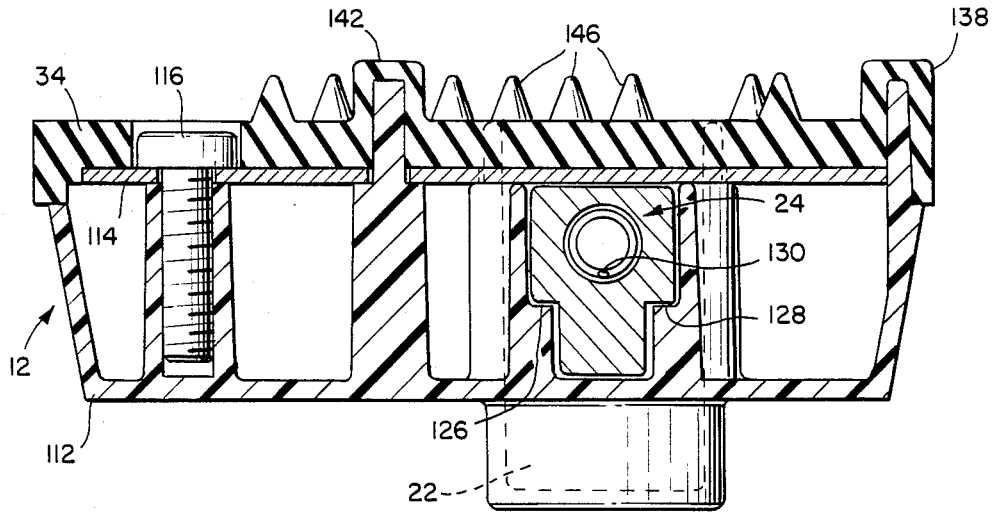
FIG. 10 is a sectional view on line 10—10 of FIG. 9.

Opening 22 in cover 12, as referred to in connection with FIG. 2, defines an elongate socket in which housing 20 of cover 10 may be received. Catch member 24 is located in a pocket 120 adjacent socket 22, the catch member being retained therein by shoulders 25, 27 on the catch member which engage walls 122, 124 delimiting the pocket, see FIGS. 6 and 9. Casing part 114 also serves to retain the catch member in the pocket, against pocket shoulders 126, 128 (FIGS. 6 and 10). A coil spring 130 is received in a blind bore 132 in the catch member and presses against wall 134 of pocket 120 to resiliently bias the catch member toward a position as shown in FIG. 6 where its ratchet teeth 26 protrude into socket 22 for engagement by teeth 30 of the latch member. It will be appreciated that the resilient mounting of the catch member allows it to be pressed into pocket 120 against the action of spring 130. Thus, a ratcheting action can take place between the respective ratchet teeth when the latch member is pressed into socket 22 without having to move the latch member against its spring 62. The covers can, therefore, be mutually engaged even when movement of the latch member is blocked by bolt 64, i.e., even when the combination lock is not set on its opening combination. However, the design of the ratchet teeth is such that withdrawal of the latch member from socket 22 can only be effected by moving the latch member out of engagement with the catch member, against the action of spring 62, by depression of push button 36. This can only be effected when the latch member is not blocked by bolt 64, i.e., when the lock is set on its opening combination.

It will be noted that the cushions 32 and 34 have various protrusions, including forward locating protrusions 136, 138 which fit over projecting portions of the respective casing parts 46 and 112, rearward locating protrusions 140, 142, fitting over posts projecting from the respective casing parts, and a series of resilient conical protrusions 144, 146 which serve frictionally to engage a trigger guard and prevent slipping of the security device. A typical positioning of cover 12 relative to a trigger and trigger guard is shown in FIG. 9, from which it will be seen that the configuration of the cover is such that it may adapt to fit firearms having differing triggers and trigger guard configurations.

It will be appreciated that the invention provides a security device for a firearm that is simple to install and remove by an authorized user and affords excellent protection against unauthorized use of a firearm, since its removal is dependent upon knowing the opening combination of the combination lock. Further, by dispensing with the need for a key to release the device, and which may be subject to loss, the integrity of the device may be enhanced compared with security devices that employ keys.

While only a single preferred embodiment of the invention has been described herein in detail, the invention is not limited thereby, and modifications may be made within the scope of the attached claims.

We claim:

1. A security device for preventing unauthorized use of a firearm, the device comprising a pair of covers adapted to be disposed on opposite sides of a firearm trigger guard, respectively, a latch member associated with one of the covers, the latch member having an elongate latching portion protruding from said one cover, and the other cover being formed with an opening in which is disposed a catch member adapted to engage and retain the latching portion when the covers are pressed together with the trigger guard therebetween and with the latching portion being projected longitudinally through the trigger guard into said opening, the covers when mutually engaged being adapted to embrace the trigger guard and prevent operation of the trigger, wherein the latching portion is supported for translational movement transversely of its length between latching and unlatching positions with respect to the catch member, and said one cover has a manual actuator for moving the latch member from the latching to the unlatching position and a lock with exposed operating means for preventing movement of the latch member from the latching position to the unlatching position except when the operating means is set to open the lock.

2. A device as claimed in claim 1, wherein said one cover includes biasing means urging the latch member toward the latching position.

3. A device as claimed in claim 1, wherein the manual actuator is formed integrally with the latch member.

4. A device as claimed in claim 3, wherein the latch member includes a pivot arm portion mounting the latch member on said one cover for pivoting movement between the latching and unlatching positions about an axis substantially parallel to the length of the latching portion.

5. A device as claimed in claim 5, wherein the latch member includes a bridging portion connecting the latching portion and the pivot arm portion, the manual actuator being formed on the bridge portion.

6. A device as claimed in claim 6, wherein the bridge portion includes a blocking shoulder with which the locking member is adapted to align to prevent actuator-initiated movement of the latch member.

7. A device as claimed in claim 5, wherein the latching portion of the latch member and the catch member are formed with complementary ratchet teeth for providing latching engagement therebetween, the arrangement of the latch and catch members being such as to permit such engagement even when the actuator-initiated movement of the latch member is blocked by the locking member, but to allow disengagement therebetween only by actuator-initiated movement of the latch member.

8. A security device for preventing unauthorized use of a firearm, the device comprising a pair of covers adapted to be disposed on opposite sides of a firearm trigger guard, respectively, a latch member associated with one of the covers, the latch member having an elongate latching portion protruding from said one cover, and the other cover being formed with an opening in which is disposed a catch member adapted to engage and retain the latching portion when the covers are pressed together with the trigger guard therebetween and with the latching portion being projected longitudinally through the trigger guard into said opening, the covers when mutually engaged being adapted to embrace the trigger guard and prevent operation of the trigger, wherein the latch member is movable transversely of the length of said latching portion between latching and unlatching positions with respect to the catch member, and said one cover has a manual actuator for moving the latch member from the latching to the unlatching position and a lock with exposed operating means for preventing movement of the latch member from the latching position to the unlatching position except when the operating means is set to open the lock, and wherein the lock includes a locking member movable between locked and unlocked positions in relation to the latch member, the locking member in the locked position blocking movement of the latch member from the latching to the unlatching position and when in the unlocked position allowing actuator-initiated movement of the latch member, and wherein the operating means comprises rotary combination dials for controlling the position of the locking member whereby the locking member assumes the unlocked position only when the dials are set on a predetermined combination.

9. A device as claimed in claim 8, wherein the dials are coaxial and are coupled with respective rotary sleeves, and wherein the locking member is a pivotal bolt having portions thereof urged into engagement with the peripheries of the respective sleeves, said peripheries each having a profile whereby pivotal movement of the bolt between the unlocked and locked positions is effected by rotation of at least one of the sleeves.

10. A security device for preventing unauthorized use of a firearm, the device comprising a pair of covers adapted to be disposed on opposite sides of a firearm trigger guard, respectively, one of the covers having an elongate protruding housing associated therewith and a latch member with an elongate latching portion disposed longitudinally in said housing and exposed at one side of said housing, the other cover being formed with an opening in which is disposed a catch member adapted to engage and retain the latching portion when the covers are pressed toward one another with the trigger guard therebetween and with said housing being projected longitudinally through the trigger guard into said opening, the covers when mutually engaged being adapted to embrace the trigger guard and prevent operation of the trigger, wherein the latching portion of the latch member is mounted for translational movement in said housing transversely toward and away from said one side thereof between latching and unlatching positions relative to the catch member, the latch member having a manual actuator protruding from said one cover for moving the latch member from the latching position to the unlatching position, and said one cover also including a lock with exposed operating means for locking the latch member in the latching position except when the lock is opened by manipulation of the operating means.

11. A device as claimed in claim 10, wherein the manual actuator is integral with the latch member.

12. A device as defined in claim 10, wherein the latching portion of the latch member includes ratchet teeth exposed at said one side of the housing for engaging complementary ratchet teeth formed on the catch member to provide a latching action therebetween.

13. A security device for preventing unauthorized use of a firearm, the device comprising a pair of covers adapted to be disposed on opposite sides of a firearm trigger guard, respectively, one of the covers having an elongate protruding housing associated therewith and a latch member with a latching portion disposed in said housing and exposed at one side of said housing, the other cover being formed with an opening in which is disposed a catch member adapted to engage and retain the latching portion when the covers are pressed toward one another with the trigger guard therebetween and with said housing being projected longitudinally through the trigger guard into said opening, the covers when mutually engaged being adapted to embrace the trigger guard and prevent operation of the trigger, wherein the latching portion of the latch member is mounted for movement in said housing toward and away from said one side thereof between latching and unlatching positions relative to the catch member, the latch member having a manual actuator protruding from said one cover for moving the latch member from the latching position to the unlatching position, and said one cover also including a lock with exposed operating means for locking the latch member in the latching position except when the lock is opened by manipulation of the operating means, and wherein the lock includes a locking member movable between a locked position that blocks movement of the latch member from the latching position and an unlocked position that releases the latch member for movement from the latching position, the lock further including combination dials constituting said operating means.

14. A device as claimed in claim 13, wherein each of the combination dials is coupled for rotation with a rotary sleeve and the locking member is urged into contact with the sleeves, and wherein the sleeves are profiled so that rotation of any sleeve may effect movement of the locking member between unlocked and locked position.

15. A device as claimed in claim 14, wherein the lock includes means for uncoupling the respective dials and sleeves when the lock is set on its opening combination whereby the dials may be rotated independently of the sleeves allowing the opening combination to be changed.

16. A security device for preventing unauthorized use of a firearm, the device comprising a pair of covers adapted to be disposed on opposite sides of a firearm trigger guard, respectively, one of the covers having an elongate protruding housing associated therewith and a latch member with a latching portion disposed in said housing and exposed at one side of said housing, the other cover being formed with an opening in which is disposed a catch member adapted to engage and retain the latching portion when the covers are pressed toward one another with the trigger guard therebetween and with said housing being projected longitudinally through the trigger guard into said opening, the covers when mutually engaged being adapted to embrace the trigger guard and prevent operation of the trigger, wherein the latching portion of the latch member is mounted for movement in said housing toward and away from said one side thereof between latching and unlatching positions relative to the catch member, the latch member having a manual actuator protruding from said one cover for moving the latch member from the latching position to the unlatching position, and said one cover also including a lock with exposed operating means for locking the latch member in the latching position except when the lock is opened by manipulation of the operating means, and wherein the latch member includes a pivot arm portion mounting the latch member on said one cover for pivoting movement between the latching and unlatching positions about a pivot axis which is substantially parallel to the length of the housing.

17. A device as claimed in claim 16 including biasing means in said housing urging the latching portion toward said one side thereof.

18. A device as claimed in claim 17, wherein the latch member includes a bridging portion between the latching portion and the pivot arm portion and the manual actuator comprises a push button formed as part of said bridging portion.

19. A security device for preventing unauthorized use of a firearm, the device comprising a pair of covers adapted to be disposed on opposite sides of a firearm trigger guard, respectively, a latch member associated with one of the covers, the latch member having an elongate latching portion protruding from said one cover, and the other cover being formed with an opening in which is disposed a catch member adapted to engage and retain the latching portion when the covers are pressed together with the trigger guard therebetween and with the latching portion being projected longitudinally through the trigger guard into said opening, the covers when mutually engaged being adapted to embrace the trigger guard and prevent operation of the trigger, wherein the latch member is movable transversely of the length of said latching portion between latching and unlatching positions with respect to the catch member, and said one cover includes a combination lock with operating means for preventing movement of the latch member from the latching position to the unlatching position except when the opening combination of the lock is set by manipulation of the operating means, and wherein the combination lock includes a pivotal locking member adapted to move between a locked position blocking movement of the latch member from the latching position, and an unlocked position permitting such movement, and dial-driven sleeves which engage the locking member and determine the position thereof dependent upon the rotational alignment of the sleeves, said dial-driven sleeves constituting said operating means.

* * * * *